US006334812B2

(12) United States Patent
Laborde et al.

(10) Patent No.: US 6,334,812 B2
(45) **Date of Patent: *Jan. 1, 2002**

(54) METHOD FOR DYNAMIC SEPARATION INTO TWO ZONES WITH A SCREEN OF CLEAN AIR

(75) Inventors: Jean-Claude Laborde, Les Ulis; Victor Manuel Mocho, Montreuil, both of (FR)

(73) Assignees: Commissariat a l'Energie Atomique; UNIR Ultra propre Nutrition Industrie Recherche, both of Paris (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/319,255

(22) PCT Filed: Dec. 9, 1997

(86) PCT No.: PCT/FR97/02238

§ 371 Date: Jul. 16, 1999

§ 102(e) Date: Jul. 16, 1999

(87) PCT Pub. No.: WO98/26226

PCT Pub. Date: Jun. 18, 1998

(30) Foreign Application Priority Data

Dec. 10, 1996 (FR) ..... 96 15151

(51) Int. Cl.[7] ..... F24F 9/00

(52) U.S. Cl. ..... 454/56; 456/190; 456/191

(58) Field of Search ..... 454/56, 190, 191, 454/192

(56) References Cited

U.S. PATENT DOCUMENTS

| | | | | |
|---|---|---|---|---|
| 5,145,459 A | * | 9/1992 | Meline et al. | 454/190 |
| 5,312,294 A | * | 5/1994 | Meline | 454/60 |
| 5,934,992 A | * | 8/1999 | Sohier et al. | 454/190 |

FOREIGN PATENT DOCUMENTS

| | | | | |
|---|---|---|---|---|
| EP | 0 099 818 | * | 2/1984 | |
| EP | 0 447 314 | * | 9/1991 | |
| FR | 2 515 319 | * | 4/1983 | |
| FR | 2 530 163 | | 1/1984 | |
| FR | 2 652 520 | | 4/1991 | |
| FR | 2 659 782 | | 9/1991 | |
| JP | 2-116794 | * | 5/1990 | 454/190 |
| WO | 91/05210 | * | 4/1991 | |
| WO | 96/24011 | * | 8/1996 | |

OTHER PUBLICATIONS

JP 36–7228, 2 pages, English translation of the abstract and the drawings, Figures 1 to 4, Feb. 06, 1959.

* cited by examiner

*Primary Examiner*—Harold Joyce
(74) *Attorney, Agent, or Firm*—Oblon, Spivak, McClelland, Maier & Neustadt, P.C.

(57) ABSTRACT

An air curtain (14) is used to dynamically separate a zone (10) to be protected and a contaminating zone (12) communicating with each other through at least one separation zone (11), the air curtain being formed by simultaneously injecting at least two adjacent clean air jets into the same direction in the separation zone (11). More precisely, the air curtain (14) comprises a slow jet, in which the tongue (16) covers the entire separation zone (11) and a fast jet inserted between the slow jet and the zone (10) to be protected and for which the injection flow is such that it induces an air flow equal to approximately half the injection flow of the slow jet, on its surface in contact with the slow jet. Preferably, clean ventilation air is also injected into the zone (10) to be protected at a flow equal to at least the air flow induced by the surface of the air curtain in contact with the ventilation air, and in any case at a speed not less than 0.1 m/s.

14 Claims, 1 Drawing Sheet

METHOD FOR DYNAMIC SEPARATION INTO TWO ZONES WITH A SCREEN OF CLEAN AIR

BACKGROUND OF THE INVENTION

Field of the Invention

This invention relates to a process for dynamically separating a contaminating zone and a zone to be protected, communicating between each other through at least one separation zone, by means of a clean air curtain obtained by injecting at least two adjacent clean air jets into the separation zone in the same direction.

The process according to the invention may be used in many industrial sectors.

A first family of industries concerned by this process includes all industries (food processing, medical, biotechnologies, high technologies, etc.), in which it is necessary to prevent the atmosphere in a given working zone from being contaminated by the ambient air carrying thermal, microbial, and/or particular and/or gaseous contamination.

Another family of industries concerned by the process according to the invention includes industries (nuclear, chemical, medical, etc.) in which individuals and their environment must be protected from toxic or dangerous products placed inside a confinement containment.

DISCUSSION OF THE BACKGROUND

At the present time, there are two types of solutions for dynamically separating two zones communicating with each other through one or more separation zones, for example in order to allow objects to be brought in and out, these two types being protection by ventilation and protection by an air curtain.

Protection by ventilation consists of artificially creating a pressure difference between the two zones so that the pressure in the zone to be protected is greater than the pressure inside the contaminating zone. Thus, if the zone to be protected contains a product that could be contaminated by ambient air, a laminar flow is injected into the zone to be protected that blows outwards through the separation zone. In the opposite case in which personnel and the environment outside a contaminated space need to be protected, dynamic confinement is achieved by using extraction ventilation in this contaminated space. In each case, an empirical rule imposes a minimum ventilated air speed of 0.5 m/s in the plane of the separation zone through which the two zones communicate in order to prevent contamination from being transferred into the zone to be protected.

However, the efficiency of this ventilation protection technique is not perfect, particularly in a so-called "infractions" situation, in other words when objects are transferred through the separation zone inserted between the two zones. Furthermore, this type of protection makes it necessary to process and control the entire zone to be protected from the contaminating external atmosphere or the entire contaminated zone. When the zone to be processed and controlled is large, this introduces a particularly high investment in operating cost. Finally, this technique of protection by ventilation only provides protection in one direction, in other words it is only useful when contamination transfers are only possible in one direction.

The air curtain protection technique consists of simultaneously injecting one or several adjacent clean air jets in the same direction into the separation zone between the two zones, which form an immaterial door between the zone to be protected and the contaminating zone.

Note that according to the theory of turbulent plane jets, a plane air jet is composed of two separate zones; a transition zone (or core zone) and a development zone.

The transition zone corresponds to the central part of the jet adjacent to the nozzle in which the speed vector is constant. This zone corresponds to the part of the jet in which there is no mix between the injected air and the air on each side of the jet. Considering a cross-section through a plane perpendicular to the plane of the separation zone, the width of the transition zone gradually decreases as the distance from the nozzle increases. This is why this transition zone is called a "tongue" throughout the rest of the text.

The development zone of the jet is the part of this jet located outside the transition zone. In this jet development zone, outside air is entrained by the jet flow. This results in variations in the speed vector and mixing of air. Air entrainment on both sides of the jet within this development zone is called "induction". Thus an air jet induces an air flow on each of its faces which depends particularly on the injection flow of the jet considered.

Document JP-B-36 7228 proposes producing an air curtain by simultaneously injecting three adjacent air jets in the separation zone and in the same direction. More precisely, a relatively fast air jet is injected between two relatively slow air jets. This arrangement is supposed to provide more efficient confinement than a single air jet, because the entrained air mixed by the central jet is only slightly contaminated, and originates from relatively slow jets injected on each side of this central air jet.

However, this document does not consider the length of the tongues of each jet, nor their injection flows, such that the confinement efficiency is very uncertain.

Document FR-A-2 530 163 proposes to control confinement in a polluted room with an opening by injecting an air curtain into it consisting of two clean adjacent air jets blowing in the same direction. More precisely, dynamic separation is provided by a first relatively slow jet (called the "slow jet"), for which the tongue entirely covers the opening. The second jet (called the "fast jet") is faster than the slow jet, and is installed between the slow jet and the zone to be protected. Its function is to stabilize the slow jet by a suction effect which brings this slow jet into contact with the fast jet.

Document FR-A-2 530 163 describes that the slow jet tongue is sufficiently long to cover the entire opening when the width of the injection nozzle for this slow jet is equal to at least one sixth of the height of the opening to be protected. It also states that injection flows of the two air jets must be such that the air flow induced by the surface of the fast jet which is in contact with the slow jet is approximately equal to the injection flow through the slow jet.

Document FR-A-2 652 520 suggests using an air curtain to protect a clean working zone provided with an opening, from the contaminating external environment. The main characteristics of the air curtain are similar to the characteristics described in document FR-A-2 530 163. It is also specified that the injection speed of the slow jet must be of the order of 0.4 m/s or 0.5 m/s. It is also specified that jets should be emitted such that the external surface of the fast jet reaches the limit of the opening plane. Due to the jet expansion angles, this results in an angle of about 12° between the median plane of the jets and the plane of the opening.

Document FR-A-2 652 520 also proposes simultaneously injecting clean ventilation air at a temperature adapted to requirements, inside the working zone to be protected. This document states that this clean ventilation air must be injected at a flow approximately equal to the flow induced by the surface of the fast jet that is in contact with clean ventilation air.

Furthermore, document FR-A-2 652 520 also indicates that the intake grille through which the two jets are recovered is located outside the opening and below the work station, so that the ventilation in the contaminated zone can be controlled. Furthermore, the two side walls which delimit the opening are extended towards the outside over a distance equal to at least the thickness of the air curtain.

Document FR-A-2 659 782 proposes adding a third relatively slow clean air jet to the two clean air jets described in document FR-A-2 530 163, so that the fast air jet is located between the two adjacent slow jets and in the same direction.

With this arrangement, which uses the main characteristics described in documents FR-A-2 530 163 and FR-A-2 652 520, the clean ventilation air injection flow inside the zone to be protected is considerably reduced. Furthermore, dynamic confinement is provided in both directions, which was not the case in the previous documents.

The reduction in the injection flow of clean ventilation air inside the zone to be protected is a result of the fact that induction in this zone is obtained as a result of the development zone of one of the slow jets, and no longer the development zone of the fast jet as was the case of an air curtain with two jets.

Despite the improvements made to the air curtain technique in these various documents, experiments and simulations made by the applicants have shown that the confinement efficiency obtained with air curtain devices described in documents FR-A-2 530 163, FR-A-2 652 520 and FR-A-2 659 782 could be considerably improved, particularly in infraction situations.

SUMMARY OF THE INVENTION

The purpose of the invention is a process for dynamic separation of two zones communicating with each other through at least one separation zone using an air curtain, the principle of which is similar to the principle described in documents FR-A-2 530 163, FR-A-2 652 520 and FR-A-2 659 782, but for which the confinement efficiency is significantly improved, particularly in infraction situations.

According to the invention, this result is achieved by means of a process for dynamic separation of a contaminating zone and a zone to be protected, communicating with each other through at least one separation zone, this process comprising the following steps:

- a first relatively slow clean air jet is injected into the said separation zone at a first injection flow, comprising a tongue capable of covering the entire separation zone;
- a second relatively fast clean air jet is injected at the same time into the separation zone, at a second injection flow, adjacent to and in the same direction as the first jet, between the zone to be protected and the first jet;

this process being characterized by the fact that the second injection flow is adjusted so that the air flow induced by the surface of the second jet in contact with the first jet is not greater than about half of the first injection flow.

The applicants have discovered and verified by experiments and by calculation, that all these characteristics are essential in order to obtain a "barrier effect" between the two zones, in other words so that the tongue effectively covers the entire separation zone.

If the induction at the surface of the fast jet created by the jet blower flow is too high, it may be considered that the slow jet tongue is overconsumed with the consequence of reducing the length of the slow jet; consequently, the coverage of the opening to be protected is imperfect (which is the case of all documents according to prior art). On the other hand, if the fast jet flow is too low, stabilization of the slow jet by induction of the surface of the fast jet in contact with the slow jet is not maximized. This is why applicants have determined that it is essential that the air flow induced by the surface of the second (fast) jet in contact with the first (slow) jet is less than, or preferably approximately equal to half of the injection flow of this first jet, and not equal to the entire injection flow as described in documents FR-A-2 530 163, FR-A-89 12861 and FR-A-2 659 782.

The air curtain may provide dynamic confinement in either direction if a third relatively slow jet is added to the first two jets. In this case, a third relatively slow clean air jet is injected into the separation zone at a third injection flow adjacent to the second jet and in the same direction as the first and second jets, between the zone to be protected and the second jet. The third jet comprises a tongue capable of covering the entire separation zone. The third injection flow is then adjusted so that it is approximately equal to the first injection flow, so that the air flows induced by the surfaces of the second jet in contact with the first and third jets respectively are not more than approximately half of the first and third injection flows. Due to these characteristics, the third jet effectively covers the entire separation zone.

Preferably, clean ventilation air is injected simultaneously inside the zone to be protected at an injection flow equal to at least the air flow induced by the second or third jet (depending on whether the air curtain has two or three jets), on the surface of the jet in contact with clean ventilation air. The applicants have discovered that this characteristic can give a "purifying effect" in the zone to be protected, particularly in infraction situations through the air curtain.

In order to optimize the purifying effect, and regardless of the number of jets used to form the air curtain, it is advantageous to inject clean ventilation air at a speed such that the speed of this clean ventilation air divided by the plane area of the separation zone is equal to at least 0.1 m/s.

If internal ventilation is used, clean ventilation air is injected over the entire rear wall or top of the zone to be protected, towards the separation zone. Therefore, the wall through which the clean ventilation air is injected is parallel to or approximately perpendicular to the plane of the separation zone.

If it is also required to control the temperature inside the protected zone, clean ventilation air is injected at a regulated temperature.

In order to further optimize the barrier effect provided by the air curtain, all clean air jets are preferably injected in directions approximately parallel to the plane of the separation zone. Furthermore, all clean air jets are advantageously recovered by an intake located facing the injection nozzles of these jets in a plane approximately perpendicular to the direction of the clean air jets.

The barrier effect provided by the air curtain may also be optimized by extending the side walls of the openings, located on each side of the clean air jets, so that they extend towards the contaminating zone over a distance equal to at least the maximum thickness of the jets.

BRIEF DESCRIPTION OF THE DRAWINGS

We will now describe two embodiments of the invention as non-limitative examples, with reference to the attached drawings, in which.

DESCRIPTION OF THE PREFERRED EMBODIMENTS

Figure 1:
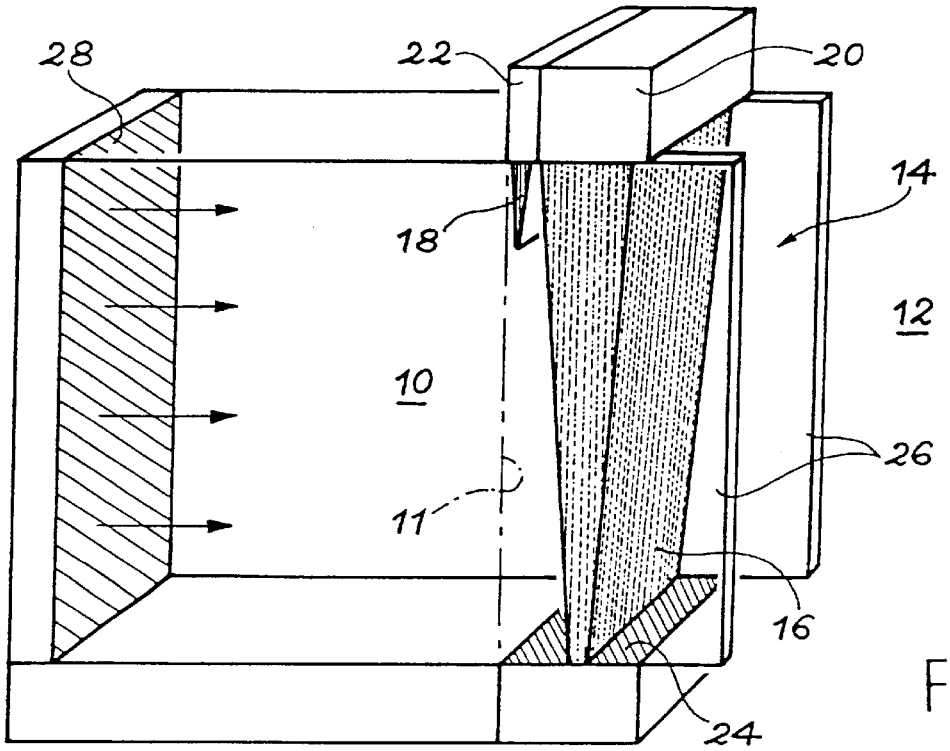
FIG. 1 is a perspective view that diagrammatically illustrates the protection of a clean working zone by means of an air curtain composed of two adjacent air jets according to a first embodiment of the process according to the invention.

A zone to be protected and a contaminating zone are marked by references 10 and 12 respectively in FIG. 1.

In the embodiment shown, the zone 10 to be protected is composed of the clean space specific to a work station, and the contaminating zone 12 includes everything outside this work station. This external space forms a source of thermal, particular, gaseous and/or microbial contamination of the space specific to the work station.

The work station that forms the zone 10 to be protected is delimited by airtight walls in all directions, except towards the right as shown in FIG. 1. More precisely, the surface of the work station facing towards the right in FIG. 1 forms a separation zone consisting of an opening 11 through which the zone 10 to be protected communicates with the external contaminating zone 12. This opening 11 may be used for example to enable objects to be taken into and out of zone 10 to be protected, and for handling when necessary inside this zone, from the outside contaminating zone 12. Note that this illustration is simply an example embodiment and is in no way restrictive, since zones 10 and 12 could communicate with each other through one or more separation zones with arbitrary orientations which are not necessarily materialized by openings, without going outside the framework of the invention.

In particular, in one embodiment not shown in which the zone to be protected is a conveyor moving along a linear, circular or winding path, the separation zone between the contaminating zone and the zone to be protected extends longitudinally along the path of the said conveyor.

In order to preserve dynamic separation between zones 10 and 12 despite the presence of opening 11, a permanent air curtain 14 is formed in this opening when the installation is being used. In the embodiment shown diagrammatically in FIG. 1, this air curtain 14 is formed by injecting two clean adjacent air jets simultaneously in the same direction.

More precisely, a first clean, relatively slow air jet is injected into opening 11 (of which only tongue 16 is shown) and a second clean air jet is also injected into opening 11, relatively fast compared with the first jet (of which only the tongue 18 is shown) The second jet is injected between the first jet and the zone 10 to be protected. For simplification purposes, the first jet and the second jet are called the "slow jet" and the "fast jet" respectively in the rest of this text.

The slow jet and the fast jet are injected into the opening 11 by adjacent nozzles 20 and 22 respectively.

In the embodiment shown in which the opening is rectangular and comprises two horizontal edges and two vertical edges (and in a non-restrictive manner), the injection nozzles 20 and 22 extend over the entire length of the upper edge of opening 11 such that the air curtain 14 is formed over the entire width of the opening 11. The two jets forming the air curtain 14 are then completely recovered through a single intake 24 that extends along the lower edge of the opening and over the entire length of this edge. The vertical edges of the opening 11 are materialized by two side walls 26 located on each side of the two jets forming the air curtain 14. These two side walls 26 extend in the contaminating zone 12 over a distance equal to at least the maximum thickness of the jets.

As shown diagrammatically in FIG. 1, the slow jet injected through nozzle 20 is sized such that its tongue 16 covers the entire plane of the opening 11 to be protected. This result is obtained by taking steps to ensure that the range, or length, of the tongue 16 is equal to at least the height of the opening 11. Consequently, the width of the nozzle 20 parallel to the plane of FIG. 1 is equal to at least $1/6^{th}$, and preferably $1/5^{th}$, of the height of the opening 11 to be protected. Thus, and solely as an example, the width of the nozzle 20 will be at least 0.20 m for a 1 m high opening.

Furthermore, in order to minimize turbulence and for economic reasons, the speed of the slow jet output from nozzle 20 is beneficially fixed at 0.5 m/s. Since the length of the tongue 16 of the slow jet is equal to at least the height of the opening to be protected and this jet is relatively slow, air streams follow the contour of objects that pass through the air curtain 14 without breaking the confinement.

However, the low speed of the slow jet injected by nozzle 20 has the consequence that this jet, if it were used alone, could be destabilized by aeraulic or mechanical disturbances that could occur close to the air curtain, thus breaking the confinement of the work station. This is why the fast jet injected by nozzle 22 is injected adjacent to the slow jet, at a higher speed in order to stabilize the first jet and consequently to improve the confinement efficiency in infraction situations through the dynamic barrier formed by the air curtain 14. As an example which is in no way restrictive, the width of the nozzle 22 through which the fast jet is injected may be equal to about $1/40^{th}$ of the width of nozzle 20, which is equal to 0.005 m in the example described.

In order to optimize the barrier effect provided by combining the two jets, the applicants have determined that the injection flow of the fast jet injected through nozzle 22 must be adjusted such that the air flow induced by the surface of this fast jet which is in contact with the slow jet injected through nozzle 20, is less than or preferably approximately equal to half the injection flow of this slow jet. Experiments and simulations have shown that this characteristic significantly improves the barrier effect compared with prior art, in which the flow of the fast jet is adjusted such that the air flow induced by the surface of this fast jet in contact with the slow jet is approximately equal to the injection flow of the slow jet.

As an example which is in no way restrictive, if the blowing flow of the slow jet injected through nozzle 22 is 360 $m^3/h$, the blowing flow of the fast jet injected through nozzle 22 should be about 42 $m^3/h$. This value should be compared with the value of about 84 $m^3/h$ recommended in prior art.

In order to recover all air blown through nozzles 20 and 22 and air entrained by the air curtain 14, the intake 24 communicates with suction means (not shown) sized for this purpose. In practice, air recovered from intake 24 is advantageously cleaned by special cleaning means (not shown) before being recycled to injection nozzles 20 and 22. Excess air is then released towards the outside after a second special cleaning.

In the numeric example given above, the air suction flow through the intake 24 is 825 $m^3/h$.

The applicants have also determined that the barrier effect is further optimized when each of the two jets is injected along a direction approximately parallel to the vertical plane of opening 11, and when the intake 24 is perpendicular to this direction. In other words, it is desirable that output orifices from nozzles 20 and 22 are located in the same horizontal lane and that the intake 24 should be located below nozzles 20 and 22 in another horizontal plane.

Furthermore, a purifying effect of zone 10 to be protected is obtained by providing internal ventilation inside this zone and respecting a defined injection flow for this internal ventilation. This purifying effect added to the barrier effect provided by the air curtain 14 significantly improves the confinement efficiency, particularly in infraction situations.

More specifically, in the embodiment shown in FIG. 1 which relates to an air curtain 14 composed of two adjacent jets in the same direction, the clean ventilation air injection flow inside zone 10 to be protected is equal to at least the air flow induced by the fast jet injected through nozzle 22, on the surface of this fast jet which is in contact with clean ventilation air, in other words on the surface of the fast jet facing zone 10 to be protected. Furthermore, clean ventilation air is injected at a speed such that the speed of this air divided by the area of the plane of the opening 11 is equal to at least 0.1 m/s.

In the embodiment illustrated diagrammatically in FIG. 1, clean ventilation air is injected into zone 10 to be protected through a blower intake grille 28 that extends over the entire back wall of the zone to be protected, in other words over the entire wall of the working zone facing the opening 11 and laid out parallel to the vertical plane of this opening. The blower intake grille 28 through which clean ventilation air is injected is located at the left in FIG. 1.

In one embodiment already mentioned (not shown) according to which the zone to be protected is a conveyor moving along a given path, the wall on which the clean ventilation air forming the purifying flow is injected is the top surface of the zone to be protected. This surface is laid out facing the conveyor and then approximately perpendicular to the plane of the separation zone.

When the temperature inside the zone 10 to be protected has to be kept at a given uniform value, the clean ventilation air is injected through the blower intake grille 28 at a regulated temperature. Consequently, temperature regulation means such as a heat exchanger (not shown) are placed in the ventilation circuit on the upstream side of blower intake grille 28.

In the non-restrictive example described above, the internal ventilation blower flow is 360 $m^3$/h.

Experiments and simulations have shown that if the characteristics described above are respected, confinement efficiencies 10 to 100 times better than efficiencies possible with prior art can be obtained. Thus with the characteristics described above, the confinement efficiency of a dynamic barrier defined as the ratio of the concentration of particular or gaseous pollutants in the contaminating zone to the concentration of the same pollutants in the zone to be protected, can reach values of between $10^4$ and $10^6$.

Figure 2:
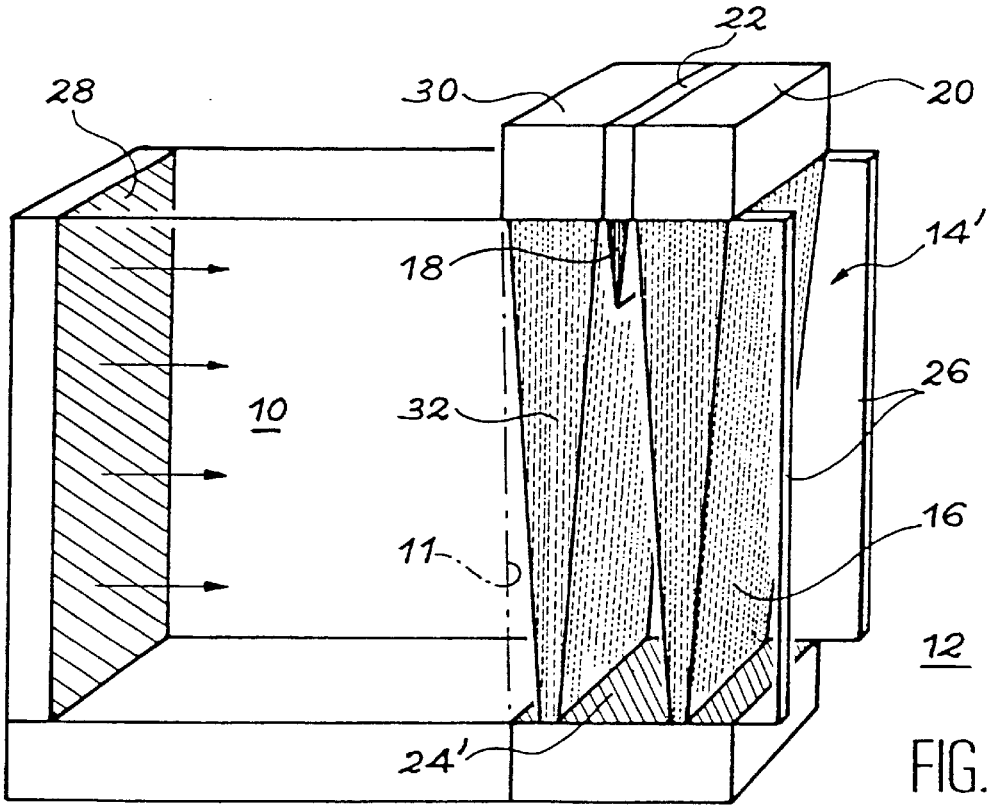
FIG. 2 is a perspective view similar to FIG. 1 which diagrammatically illustrates the protection of a clean working zone by means of an air curtain composed of three adjacent air jets according to a second embodiment of the process according to the invention.

FIG. 2 shows a second embodiment of the process according to the invention. This second embodiment uses the same main characteristics described above with reference to FIG. 1, plus a third relatively slow jet between the fast jet and the zone to be protected. This is why elements of the installation illustrated in FIG. 2 that are identical to the elements in the installation described above with reference to FIG. 1, are referenced with the same reference numbers, and will not be described in detail.

Thus, FIG. 2 shows the zone 10 to be protected, the contaminating zone 12, the opening 11, nozzles 20 and 22 through which the slow jet and the fast jet respectively are injected, the respective tongues being illustrated as 16 and 18, the side walls 26 of the opening 11 and the blower intake grille 28 providing internal ventilation of the zone 10 to be protected.

The air curtain, in this case, denoted by reference 14', also comprises a third clean air jet, relatively slow with respect to the fast jet, output through a nozzle 30 adjacent to nozzle 22 between the fast jet and zone 10 to be protected, such that it is adjacent to the fast jet and in the same direction as the other jets. The tongue from this third jet is illustrated as 32 in FIG. 2.

The dimensions of the nozzle 30 are chosen such that the tongue 32 of the third jet covers the entire opening. Consequently nozzle 30 extends over the entire length of the upper edge of opening 11, like nozzles 20 and 22, and the width of this nozzle 30 is equal to at least $1/6^{th}$ and preferably $1/5^{th}$ of the height of opening 11. In practice, the widths of nozzles 20 and 30 are the same, for example 0.20 m in the case of the numeric illustration given non-restrictively above with reference to FIG. 1.

In the second embodiment of the process according to the invention, the slow jet injection flow output through nozzle 30 is adjusted such that this flow is approximately equal to the slow jet injection flow output through nozzle 20. Thus, air flows induced by the surfaces of the fast jet output through nozzle 22 in contact with each of the slow jets, are less than or preferably approximately equal to half of the injection flows from these slow jets.

As illustrated in FIG. 2, note that the width of the intake grille, in this case denoted by reference 24', is adapted to the width of the air curtain so that all jets can be recovered through this intake grille 24'. More precisely, the intake grille 24' for air curtain 14' formed by three jets, is wider than the intake grille 24 of the air curtain 14 formed by two jets.

The use of an air curtain 14' formed by three adjacent jets in the same direction gives efficient dynamic separation of the two zones in both directions.

Furthermore, in the second embodiment illustrated in FIG. 2, the presence of another slow jet between the fast jet and zone 10 to be protected, can reduce the injection flow of the internal ventilation compared with the first embodiment. The injection flow of clean ventilation air through the blower intake grille 28 is then equal to at least half the air flow induced by the slow jet emitted through nozzle 30 on the surface of this third jet which is in contact with the clean ventilation air.

In the numeric example given above, the injection flow from each of the slow jets is 360 $m^3$/h, the blower flow of the internal ventilation is 360 $m^3$/h and the suction flow in the intake grille 24' is 1185 $m^3$/h.

As in the first embodiment of the invention, the three jets are preferably injected in directions parallel to the plane of the opening 11 and the intake grille is located below the injection nozzles 20, 22 and 30 and is perpendicular to this plane. Furthermore, the speed at which ventilation air is injected in the zone 10 to be protected is advantageously equal to at least 0.1 m/s.

The confinement efficiencies obtained in the second embodiment of the invention illustrated in FIG. 2, are similar to the confinement efficiencies given in the case of the first embodiment described above with reference to FIG. 1.

Note that many modifications may be made to the described installations, without going outside the framework of the invention.

These modifications firstly relate to applications, which are many and relate to all cases in which it is necessary to make a thermal and dynamic separation between two environments with different gaseous, particular and/or bacteriological concentrations (one clean environment and the other contaminated environment, and possibly at different temperatures), while allowing objects to pass repeatedly from one zone to the other without the clean zone becoming contaminated. Examples of these applications are to protect food processing, medical, biotechnological or high technology work stations, display counters for the distribution of sensitive products, etc.

Possible modifications also relate to the shape, orientation and the number of separation zones through which the two zones communicate, and the choice of edges of the separation zone on which injection nozzles and the intake grille may be located, which may be different from the layout described above.

What is claimed is:

1. A process for dynamic separation of a contaminating zone and a zone to be protected, communicating with each other through at least one separation zone, comprising the steps of:

injecting a first jet of relatively slow clean air into said at least one separation zone at a first injection flow rate so as to form a tongue of air covering the at least one separation zone;

injecting a second jet of relatively fast clean air simultaneously into the at least one separation zone at a second injection flow rate, adjacent to and in the same direction as the first jet, said second jet being injected between the zone to be protected and the first jet; and adjusting the second injection flow rate so that an air flow rate induced by a surface of the second jet in contact with the first jet is not greater than substantially half of the first injection flow rate.

2. The process according to claim 1, wherein said adjusting step comprises adjusting the second injection flow rate so that the air flow rate induced by the surface of the second jet in contact with the first jet is equal to approximately half of the first injection flow rate.

3. The process according to claim 1, further comprising injecting clean ventilation air simultaneously inside the zone to be protected at an injection flow rate equal to at least the air flow rate induced by the second jet, the surface of which is in contact with the clean ventilation air.

4. The process according to claim 1, further comprising:

injecting a third jet of relatively slow clean air into the at least one separation zone at a third injection flow rate, adjacent to the second jet and in the same direction as the first and second jets, between the zone to be protected and the second jet, the third jet comprising a tongue for covering the at least one separation zone; and adjusting the third injection flow rate so that it is approximately equal to the first injection flow rate, such that air flows induced by surfaces of the second jet in contact with the first and the third jets respectively, are not more than substantially half the first and third injection flow rates.

5. The process according to claim 4, wherein said adjusting step of the third injection flow rate comprises adjusting the third injection flow rate such that the air flows induced by the surfaces of the second jet in contact with the first and third jets respectively are equal to substantially half of the first and third injection flow rates.

6. The process according to claim 4, further comprising injecting clean ventilation air simultaneously inside the zone to be protected, at an injection flow rate equal to at least the air flow rate induced by the third jet on the surface of an air flow in contact with the clean ventilation air.

7. The process according to claim 3, wherein said injection of the clean ventilation air comprises injecting the clean ventilation air at a speed such that a speed of said clean ventilation air divided by an area of a plane of the at least one separation zone is equal to at least 0.1 m/s.

8. The process according to claim 3, wherein said injection of the clean ventilation air comprises injecting the clean ventilation air over an entire surface of a wall of the zone to be protected, in a direction of the at least one separation zone.

9. The process according to claim 8, wherein the injecting of the clean ventilation air over the wall comprises injecting the clean ventilation air over a rear wall of the zone to be protected, said rear wall being parallel to a plane of the at least one separation zone.

10. The process according to claim 8, wherein the wall on which the clean ventilation air is injected is positioned at the top of the zone to be protected, laid out substantially perpendicular to a plane of the at least one separation zone.

11. The process according to claim 3, further comprising regulating a temperature of the clean ventilation air.

12. The process according to claim 1, wherein said injecting of the first and second jets comprises injecting the first and second jets in directions approximately parallel to a plane of the at least one separation zone.

13. The process according to claim 1, further comprising recovering air from each of the first and second jets through an intake grille installed facing injection nozzles through which said first and second jets are injected and located in a plane approximately perpendicular to a direction of the first and second jets.

14. The process according to claim 1, further comprising confining a boundary of the at least one separation zone by plural side walls located on each side of the first and second jets extending towards the contaminating zone over a distance equal to at least a maximum thickness of the first and second jets.

* * * * *